United States Patent [19]

Pels-Leusden et al.

[11] 4,064,639

[45] Dec. 27, 1977

[54] INSTALLATION FOR DRYING MOLDED BLANKS

[75] Inventors: Carl Otto Pels-Leusden; Robert Stupperich; Hans-Bernd Weber; Rudi Reinders, all of Essen, Germany

[73] Assignee: Institute fur Ziegelforschung Essen e.V., Essen, Germany

[21] Appl. No.: 605,483

[22] Filed: Aug. 18, 1975

[51] Int. Cl.[2] ..... F26B 19/00

[52] U.S. Cl. ..... 34/212; 34/216; 34/233

[58] Field of Search ..... 34/209–217, 34/233, 234, 236, 105, 219

[56] References Cited

U.S. PATENT DOCUMENTS

| | | | |
|---|---|---|---|
| 1,608,263 | 11/1926 | Fiege | 34/212 |
| 2,386,835 | 10/1945 | Beatty | 34/233 |
| 2,618,075 | 11/1952 | Everhart | 34/105 |
| 2,736,108 | 2/1956 | Muyderman | 34/212 |
| 3,526,970 | 9/1970 | Harrison et al. | 34/213 |

*Primary Examiner*—Kenneth W. Sprague
*Assistant Examiner*—James C. Yeung
*Attorney, Agent, or Firm*—Allison C. Collard

[57] ABSTRACT

A drying installation for the drying of molded blanks, such as plank bricks, large surface structural members of ceramic material and the like, having a substantially closed drying chamber separated into a plurality of adjacently arranged parallel drying channels, an air supply coupled to each of the parallel drying channels for supplying dry air having a different temperature, humidity and flow rate, and a conveyor for moving the molded blanks through the drying chamber, the conveyor being guided perpendicularly with respect to the flow of the dry air through the adjacently arranged drying channels.

15 Claims, 4 Drawing Figures

INSTALLATION FOR DRYING MOLDED BLANKS

The subject invention relates to a drying plant installation for the drying of molded blanks.

More particularly, the invention relates to a drying plant for brick and the coarse ceramic industry and, preferably for drying plank bricks, i.e., large surface structural members made of ceramic material. The drying plants consist of a substantially closed drying chamber, at least one conveyor means for moving the molded blanks through the drying chamber, and an air supply for drying the molded blanks. The drying chamber is separated into a plurality of parallel drying channels. Dry air is supplied to individual drying channels having different temperature, and/or humidity, and/or speed (respectively-dry air of different quantity).

It is well known and advantageous to construct walls with bricks. However, there is a disadvantage to building walls with relatively small construction elements such as bricks. The result is a high labor cost, and the physical disadvantages of having many joints or seams between the individual bricks.

Presently, different construction elements such as for example, large surface concrete slabs are used, which extend one story high, and are several meters wide. However, correspondingly large surface construction elements made of ceramic could hitherto not be manufactured for the following reason. Practice has shown that the production difficulties in the brick industry grow proportional with the size of the construction element when construction elements are made from ceramic material. In particular, the drying with the resulting shrinking and simultaneous low self-rigidity poses an almost insurmountable problem when large surface construction elements such as plank bricks are made from ceramic material. As a matter of fact the resulting shrinking during the drying process is between 5–10%. At the same time and in conjunction with the shrinking during drying, tension cracks appear, and deformation of the construction element occurs. When smaller construction elements such as bricks are made, these undesirable factors are of lesser importance, but are absolutely unacceptable when making plank bricks, i.e., large surface construction elements made of ceramic materials.

In an older prior art German Pat. application of applicant No. (P 23 61 945.6) which does not relate to the state of the art, it is an object of the invention to teach how plank bricks can be made for practical use, i.e., for large surface constructional elements made of ceramic material.

In this patent application, the ceramic material of the plank brick is evenly and rapidly dried over its entire cross-sectional area. It has thus been found that the resulting shrinking during drying (and during the sintering) of the ceramic material in itself is not a hinderance when making plank bricks. In other words, the inevitable shrinking does not necessarily result in cracks or deformation of the element, and particularly not if the element is dried evenly and rapidly across its total cross section. Moreover, the cross sectional area of the plank brick is placed between adjacent pipes, so that the dry air which flows through the pipes by a defined hydraulic cross section and wall thickness transmit an even rapid drying effect across its cross section. Naturally, the plank brick made with this method is still a monolithic element, the cross section of which is sectioned by the individual pipes. In other words, the required even and rapid drying across its cross sectional surface is obtained since the plank brick is sectioned into a plurality of individual "drying objects," so that care has to be taken that the individual "drying objects" are evenly and rapidly dried..

This patent application provides various other possibilities and further embodiments for the heretofore described method, which is not necessary to discuss. To carry out the method of the older patent application, a drying installation is required. It is an object of subject application to provide a drying installation to be used for drying of molded blanks, in particular, in bricks and coarse ceramic objects.

In the inventive drying installation, the conveyor means is moved perpendicular with respect to the flow direction of the dry air through adjacent drying channels. At this point, the step of separating the drying space into a plurality of parallel drying channels will be defined. This separation of the drying chamber into a plurality of parallel drying channels is primarily a functional one, so that the dry air may be introduced into the individual channels with different speed, and/or temperature, and/or humidity. Therefore, it is not necessary to separate the drying chamber by means of stationary separating walls, or the like.

There are many possibilities for shaping the drying installation which in the following will be shown in form of examples. In the older patent application, there is a return of direction of the dry air through the plank brick at a relatively short time interval. Thus, the plank brick can be moved with the required rhythm in a reciprocal movement from drying channel to drying channel, while in adjacent drying channels, the dry air is moved in different directions. This reciprocating movement of the plank bricks is relatively expensive. Therefore, in a further teaching of the present invention, the dry air is moved in alternate directions through the adjacent drying channels, instead of providing a reciprocating movement of the plank bricks. Therefore, it is advantageous to at least partially connect the individual drying channels in series with respect to the guiding of the dry air. In order to operate these drying channels variably, it is recommended that slides be provided. With the assistance of the slides, the individual drying channels may alternately switched in series or parallel with respect to each other. Naturally, some individual drying channels may be switched parallel while others may be switched in series. The number of parallel switched drying channels defines the lengths of the staying time of the plank bricks under stable drying conditions, while the number of drying channels switched in series defines how often the drying conditions change.

From the start of the drying process, to about the end of the shrinking at the inlet openings for the plank bricks, it is advantageous not only to often change the direction of the drying air, but also periodically interrupt the drying process for considerable time periods, while operating at a considerably higher drying air speed during the drying phases. In order to realize a technical and economical advantage, it is suggested to provide mobility to individual drying channels or groups of parallel and/or switched in series drying channels with respect to the moving direction of the molded blanks, but independent from the total drying installation. For this purpose, separate dry air and energy supply and exhaust means have to be provided for these drying channels or group of drying channels.

The conveyor means which in the subject invention, is moved perpendicular with respect to the flow direction of the dry air through the adjacent drying channels, receives the molded blanks to be dried either directly or indirectly, and moves them through the drying chamber. This conveyor means may consist of various embodiments. Advantageously, the conveyor means is in the form of a pallet and moves over rollers and guide rails through the drying chamber.

As mentioned above, when large surface constructional elements are dried in the form of plank bricks, the shrinking and simultaneous low self rigidity is a special problem. In order to avoid deformation of the plank bricks during shrinking, the plank brick must be substantially freely moveable on the conveyor means, i.e., no large frictional forces should be created. This can be achieved by various means.

In a first embodiment of the inventive drying installation at least one gravity roll carrier is provided on the conveyor means which corresponds to the moving direction and the flow direction of the dry air, i.e., the movement is vertical with respect to the conveyor movement. Consequently, the plank bricks can shrink in the rolling direction without overcoming frictional forces which may result in deformation of the bricks. In order that the plank bricks to be dried can shrink in the roller direction, i.e., perpendicular with respect to the flow direction of the dry air without overcoming large frictional forces, at least two gravity roller carriers are provided, and the gravity roll carrier and/or the individual rollers of the gravity roll carrier are arranged perpendicularly moveable with respect to the roller direction. The gravity roll carrier and/or the individual rollers of the gravity roll carrier may be mounted on the conveyor means by means of rollers and/or ball bearings.

The previously mentioned problem of mounting the plank bricks on the conveyor means may also be solved in that a special gliding surface having a low friction coefficient between the sliding surface and the molded blank, may be provided on the conveyor means. Furthermore, a special gliding film may be applied onto the conveyor means or the gliding face. Finally, at least one freely moveable foil may be placed onto the conveyor means. If two foils are used, a gliding film may be applied between the two foils. The supply and conditioning of the dry air which is required in the inventive drying installation may be carried out in different ways. In most cases, it is advantageous to provide a blower, preferably a heater, and preferably at least one straightener to each drying channel or to each group of parallel switched drying channels. If a heater is provided for each drying channel in addition to the blower, the speed, the temperature and/or the humidity in the drying channels can be individually adjusted. By adding a straightener, as suggested, the flow of the drying air through the plank brick can be evenly adjusted. Due to the high requirement for an even flow through of the plank bricks, each individual inlet and outlet opening of the plank bricks should be provided with diaphragms made of flexible material such as, for example, rubber, paper, etc. The cross sectional area of the aperture of those diaphragms should be smaller than the flow through cross sectional area of the plank bricks.

Advantageously, these diaphragms for each plank brick are encompassed in a diaphragm plate. Furthermore, it is advantageous to provide the blower for the dry air in the rear of the molded blanks in the flow direction of the dry air, so that the blower draws the air through the molded blanks. If the dry air should be operated in different directions through one drying channel, a plurality of drying channels or all the drying channels, two blowers should be positioned on these individual drying channels or all of the drying channels, so that the dry air can be sucked through the molded blanks in both directions. Finally, it is possible to connect the blower or blower channel to the molded blanks by, for example, guiding sheet metal plates and/or flaps. It is always advantageous to guide the dry air through the plank bricks to be dried directly, i.e., to avoid a flow of drying air outside of the molded blanks.

If plank bricks of different thicknesses have to be dried, it is recommended that the conveyor means or the gravity roll carrier be adjustable in a heightwise direction so that a symmetric admission of the plank bricks to be dried is possible.

In further teachings of the invention, the individual drying channels are sealed by means of sand grooves and engaging sealing guard plates are provided in the sand grooves. It is also possible to provide a separating wall on the conveyor means in the flow direction of the dry air, so that together with the conveyor means, simultaneously moving drying channels move through the drying chamber.

While the fresh dry air contains about 6 g water per kg of air, the used dry air contains about 100 g. per kg of dry air. The result is a water vapor pressure of about 160 kp/m$^2$, while a pressure differential to the environment of about 10 kp/m$^2$ prevails. In view of the high water pressure vapor, the drying installation must be water vapor proof on the inside, so as to prevent a water vapor diffusion.

Other objects and features of the present invention will become apparent from the following detailed description when taken in connection with the accompanying drawings which disclose several embodiments of the invention. It is to be understood that the drawings are designed for the purposes of illustration only, and are not intended as a definition of the limits and scope of the invention disclosed.

In the drawings, wherein similar reference numerals denote similar elements throughout the several views.

Figure 1:
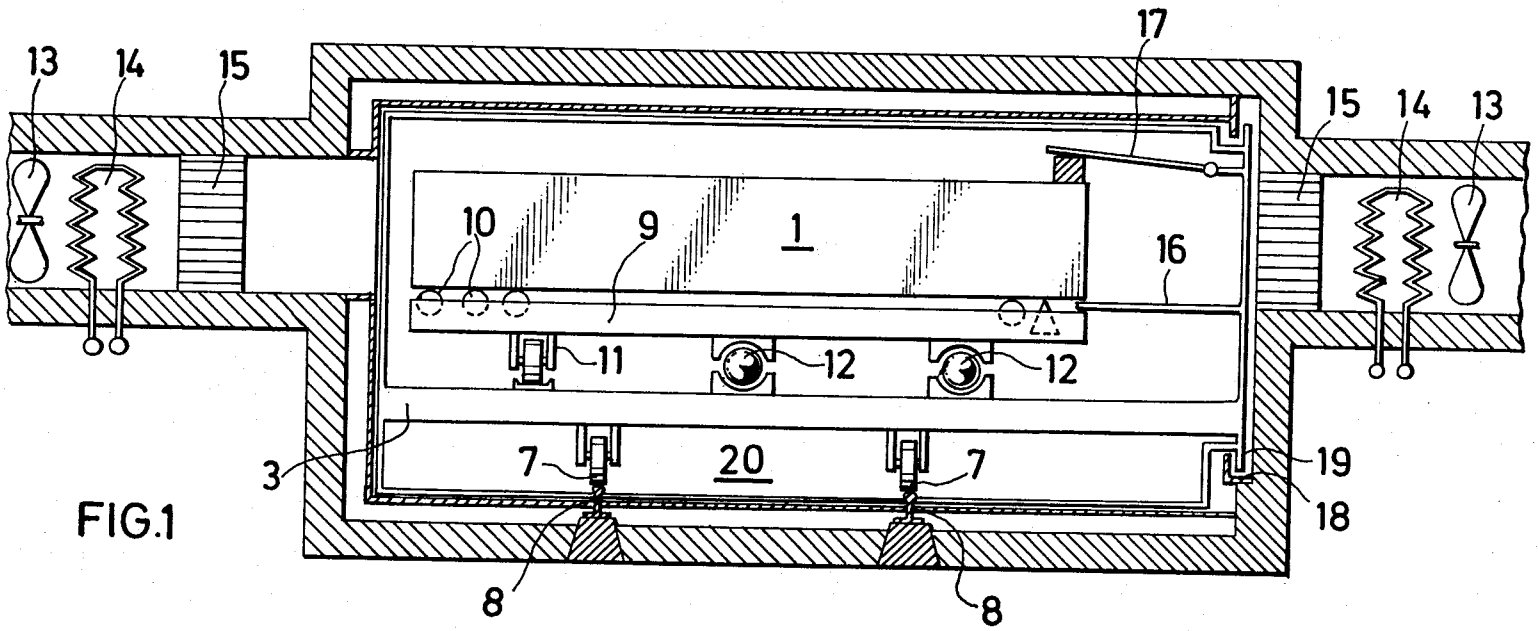
FIG. 1 is a cross sectional view through a specific embodiment of the inventive drying installation.
Figure 2:
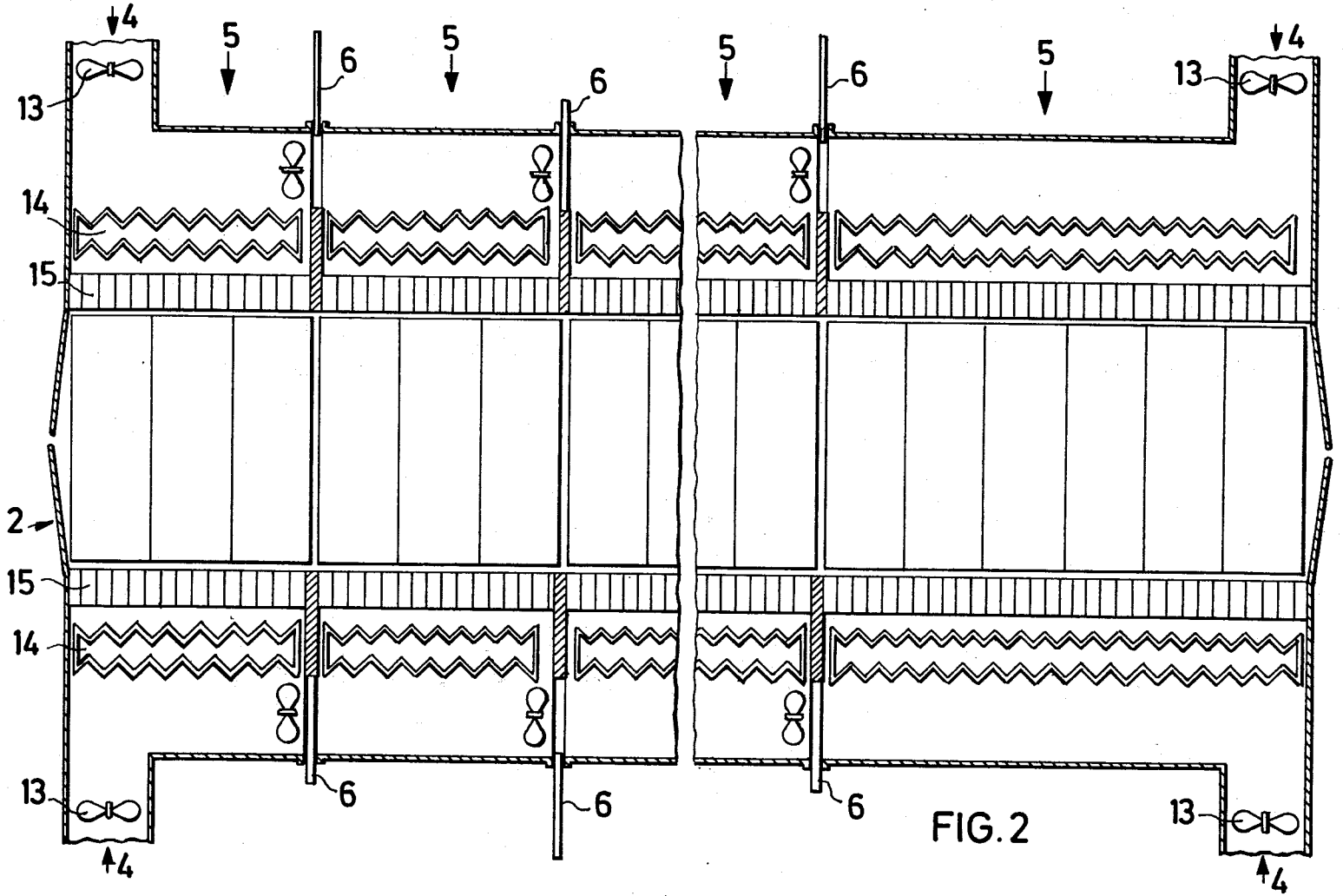
FIG. 2 shows schematically, the plan view of a specific embodiment of the inventive drying installation.

Referring to FIGS. 1 and 2, there is shown a drying installation for the drying of molded blanks, namely for drying of plank bricks 1 such as large surface constructional elements made of ceramic material. The drying installation consists essentially of a closed drying chamber 2, a conveyor means 3 which moves plank bricks 1 through drying chamber 2, and a plurality of dry air supply means 4. As shown in FIG. 2, drying chamber 2 is separated into a plurality of parallel drying channels 5, and dry air is fed to at least individual drying channels having different temperature, and/or humidity, and/or speed, and/or different quantity.

As can be seen from FIGS. 1 and 2, conveyor means 3 is arranged perpendicular to the flow direction of the dry air, and is guided through adjacent drying channels 5. There is also the possibility of guiding the dry air in an alternate direction through the adjacent drying channels 5, as will be explained in conjunction with FIG. 3. The individual drying channels are partly switched in series with respect to each other to guide the dry air as will also be explained with respect to FIG. 3.

Drying channels 5 are switched in series by means of slides 6, which are provided between the individual drying channels 5. In FIG. 1, conveyor means 3 is in form of a pallet, and is moveable by means of rollers 7 on tracks 8 in the drying chamber 2. FIG. 1 also shows that on conveyor means 3, gravity roll carriers 9 with associated rollers 10 are provided so that the rolling direction corresponds to the flow direction of the dry air, i.e., perpendicular with respect to the conveyor movement. Two gravity roll carriers 9 are provided which are moveable perpendicular to the roller movement. For this purpose, gravity roll carriers 9 are mounted on conveyor means 3 by means of rollers 11 and balls 12.

Figure 4:
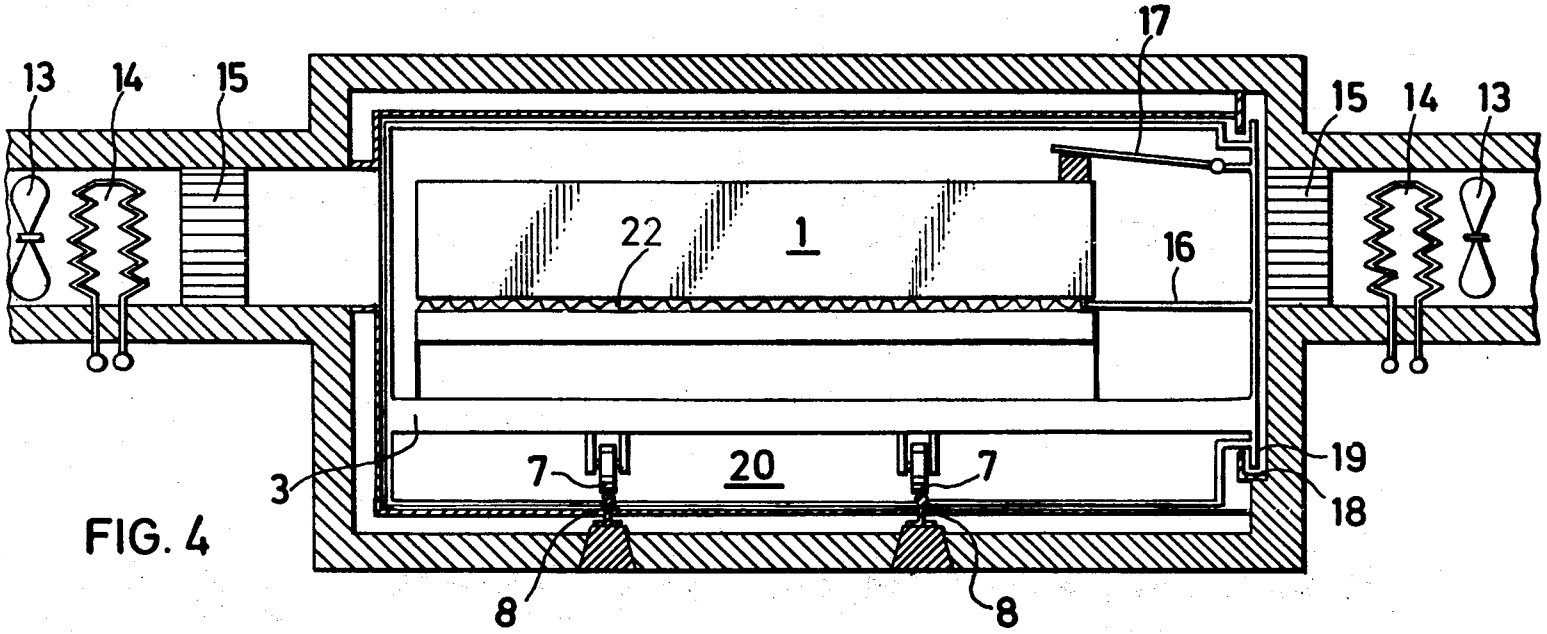
FIG. 4 is a cross section view through another embodiment of the inventive drying installation.

In FIG. 4, coneyor means 3 is in form of a pallet, and is movable by means of rollers 7 on tracks 8 in the drying chamber 2. FIG. 4 shows the flexible diaphragm plate 22 beneath the plank bricks 1.

In the embodiment shown, two blowers 13, two heaters 14, and two air straighteners 15 are provided for each drying channel 5. With the aid of blowers 13, and heaters 14, the dry air in each individual drying channel may be conditioned individually. In other words, the temperature, and/or the humidity of the dry air may be adjusted within defined limits. As mentioned before, each drying channel is provided with two blowers 13. However, only one of blowers 13 is switched on in the flow direction of the dry air at the rear of plank bricks 1, so that blower 13 draws the dry air through plank brick 1.

Blowers 13 may also be used as so called reverse blowers in conjunction with a reversable conveyor means. Air straighteners 15, provided at both ends of drying channels 15 assure that the dry air is sucked through plank brick 1 in an even flow.

Finally, FIG. 1 shows that blowers 13 may be connected to plank bricks 1 in the form of a channel, if need be, connected thereto on both sides by sheet metal guides 16 and flaps 17. Individual drying channels 5 are sealed by sand grooves 18 which are engaged by guard plates 19, and separating walls 20 are provided at conveyor means 3 in flow direction of the dry air. If plank bricks 1 to be dried are especially large, it is advantageous to mount blowers 13 and air straighteners 15 onto the individual conveyor means 3. Other mechanical means may be provided for sealing purposes instead of sand grooves 18, and plate guards 19 engaging the sand grooves. In particular, drying channels 5 may be sealed by means of apertured steel sheet metal band. In this way, the conveyor means 3 with guide sheet metal plates 16 and flaps 17 may be connected closely to the steel sheet metal band during the drying cycle.

Figure 3:
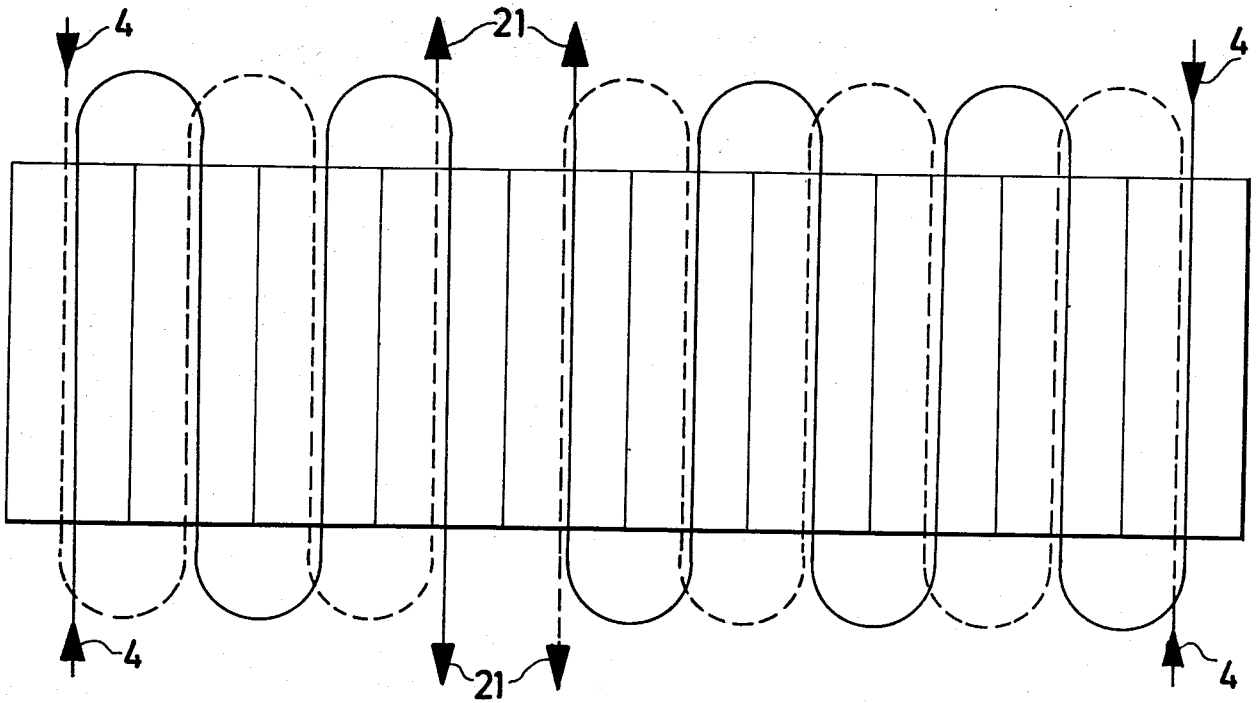
FIG. 3 is a view showing a preferred type of guide for the dry air in the inentive drying installation.

FIG. 3 shows how the dry air may be advantageously guided. First of all, measures are taken to guide the dry air in alternate directions through each individual drying channel 5. This feature is shown in FIG. 3 in terms of a solid and the dotted lines. The different flow direction of the drying air in individual drying channels 5 is obtained so that blower 13 may be operated at one side of the drying channel and also at the other side of the drying channel. Accordingly, slides 6 must be operated accordingly. At the input side of drying chamber 5, i.e., the side where plank bricks 1 are fed into drying chamber 2, it is advantageous to guide the air flow in a straight flow. At the exit side of drying chamber 2, it is recommended to guide the air flow in counter direction.

The transition between "feed in side" and "feed out side" should preferably be chosen at the point where the shrinking of plank brick 1 is finished during the drying cycle. In the shown embodiment, dry air supply ports 4 are provided at the beginning and at the end of drying chamber 2. At the inner end of the "input feed" and at the inner side of the "output side" of drying chamber 2, dry air exhausts 21 are provided.

The figures show a generally horizontal drying installation. However, it is naturally possible to construct the total drying installation perpendicular, i.e., in a bucket belt type position.

While only a few embodiments of the present invention have been shown and described, it will be obvious to those skilled in the art that many changes and modifications may be made thereunto without departing from the spirit and scope of the invention.

What is claimed is:

1. A drying installation for the drying of molded blanks such as plank bricks, large surface structural members of ceramic materials and the like comprising:

a substantially closed longitudinally extending drying chamber separated into a plurality of adjacently arranged parallel drying channels, each said drying channel comprising at least one blower with adjustable flow direction, at least one heater, at least one air straightener, said parallel drying channels being separated into two groups, said chamber having an entry end and an exit end;

air supply means coupled to each of said parallel drying channels for successively admitting and guiding dry air having different temperature, humidity, flow rate, and quantity;

means for switching said two groups of said drying channels in series with respect to said air supply means to guide the dry air in an alternate direction through said parallel arranged drying channels;

conveyor means for moving the blanks in a longitudinal direction through said drying chamber, said conveyor means being guided perpendicularly with respect to the flow of the dry air through said adjacently arranged drying channels;

means for admitting drying air to one of said two groups of channels at the entry end where the blanks enter said drying chamber and in the same direction of movement as said conveyor means, means for admitting drying air to the other of said two groups of channels in a countercurrent flow opposite to the direction of movement of said conveyor means at said exit end where the blanks leave said drying chamber; and exhaust means in said drying chamber for drying air at the point in said drying chamber where the shrinking process of the blanks is completed, said exhaust means being located between said entry end and said exit end.

2. The drying installation as set forth in claim 1, said switching means comprising slides whereby to close one of the drying channels against one of the other drying channels, and each channel including two blowers and means to reverse one of said blowers.

3. The drying installation according to claim 1, said blowers being mounted in said channels in close proximity to and above said conveyor means for moving the blanks.

4. The drying installation according to claim 1, the blanks being displaceably mounted on said conveyor means in the flow direction of the dry air flow.

5. The drying installation according to claim 1, wherein said conveyor means comprises a movable pallet, having rollers and spaced apart tracks disposed within said drying chamber for receiving and supporting said rollers, the movement of said rollers being lateral to the flow direction of the drying air.

6. The drying installation in accordance to claim 1 comprising at least one gravity roll carrier mounted on said conveyor means, the direction of said roll carrier corresponding to the flow direction of the dry air, and perpendicular with respect to the conveyor movement.

7. The drying installation according to claim 6 comprising at least two gravity roll carriers having the individual rollers, said roll carriers being moveable perpendicular with respect to the roller direction.

8. The drying installation according to claim 7 wherein said gravity roll carriers and said individual rollers are mounted on said conveyor means by means of further rollers and balls.

9. The drying installation according to claim 1 comprising a special gliding surface disposed on said conveyor means and having a low frictional coefficient between the gliding surface and the molded blank.

10. The drying installation in accordance with claim 9 wherein a sliding film is applied on said conveyor means.

11. The drying installation in accordance with claim 1 comprising at least one freely moving foil placed on said conveyor means.

12. The drying installation according to claim 1, wherein said blower is disposed at the rear of the molded blanks seen from the flow direction of the drying air.

13. The drying installation according to claim 1 comprising guide plates and flaps connected to said blower for closely coupling said blower to the molded blanks in a channel-like fashion.

14. The drying installation according to claim 1 comprising sand grooves and sealing gate guards, wherein said drying channels are sealed with respect to each other at least on one side due to said sand grooves and said sealing gate guards which engage the sand grooves.

15. The drying installation according to claim 1 comprising at least one separating wall is provided in said conveyor means in at least the direction of flow of the dry air.

* * * * *